US010112398B2

(12) United States Patent
Iida et al.

(10) Patent No.: US 10,112,398 B2
(45) Date of Patent: Oct. 30, 2018

(54) LIQUID DISCHARGING APPARATUS

(71) Applicant: BROTHER KOGYO KABUSHIKI KAISHA, Nagoya-shi, Aichi-ken (JP)

(72) Inventors: Shotaro Iida, Nagoya (JP); Toshiro Ueda, Kiyosu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/408,569

(22) Filed: Jan. 18, 2017

(65) Prior Publication Data

US 2017/0203571 A1 Jul. 20, 2017

(30) Foreign Application Priority Data

Jan. 19, 2016 (JP) ..... 2016-007550

(51) Int. Cl.
*B41J 2/165* (2006.01)

(52) U.S. Cl.
CPC ..... *B41J 2/1652* (2013.01); *B41J 2/16505* (2013.01)

(58) Field of Classification Search
CPC ..... B41J 2/1652; B41J 2/16505
See application file for complete search history.

(56) References Cited

U.S. PATENT DOCUMENTS

2007/0176963 A1 8/2007 Morikoshi
2010/0053257 A1* 3/2010 Kubo ..... B41J 2/16526 347/30
2013/0343938 A1* 12/2013 Hutchison ..... B41J 2/175 417/477.7

FOREIGN PATENT DOCUMENTS

JP H10-100450 A 4/1998
JP 2007-230204 A 9/2007
JP 2007-268806 A 10/2007
JP 2010-017993 A 1/2010

* cited by examiner

*Primary Examiner* — Sharon A Polk
(74) *Attorney, Agent, or Firm* — Scully, Scott, Murphy & Presser, P.C.

(57) ABSTRACT

There is provided a liquid discharging apparatus including: a liquid jet head, a receiving portion, a tube pump, and a controller. The controller carries out a process of acquiring present positional information of a pressing body inside the tube pump and a simultaneous process which simultaneously performs a flushing process and a discharge process and, as the flushing process, carries out a process of selectively performing either an ordinary flushing process or a restrained flushing process. In the simultaneous process, the controller carries out either the ordinary flushing process when the pressing body is not positioned to press an overlapped portion of a tube or the restrained flushing process when the pressing body is positioned to press the overlapped portion of the tube.

17 Claims, 10 Drawing Sheets

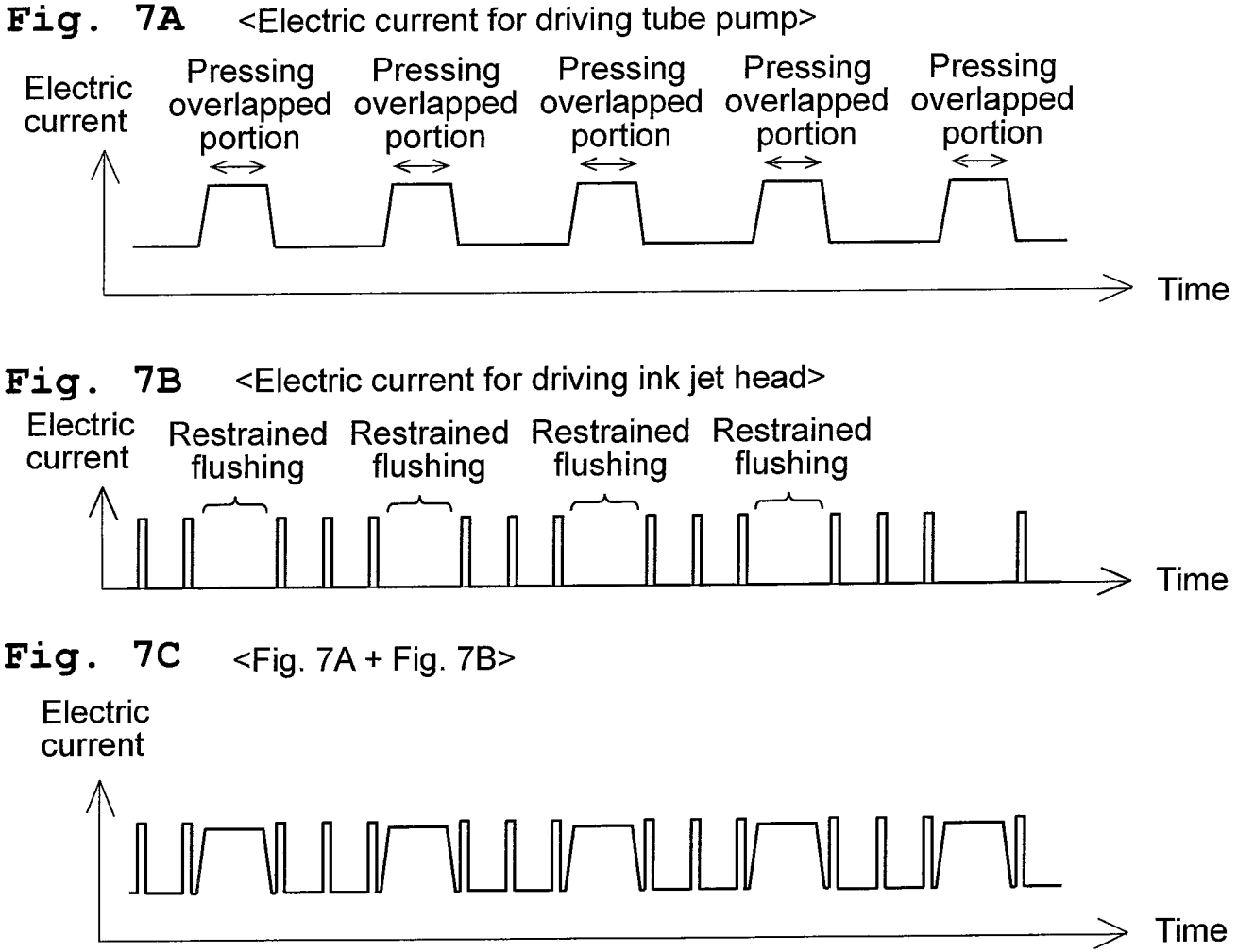
Fig. 7A
<Electric current for driving tube pump>
Electric current
Pressing overlapped portion
Pressing overlapped portion
Pressing overlapped portion
Pressing overlapped portion
Pressing overlapped portion
Time
Fig. 7B
<Electric current for driving ink jet head>
Electric current
Restrained flushing
Restrained flushing
Restrained flushing
Restrained flushing
Time
Fig. 7C
<Fig. 7A + Fig. 7B>
Electric current
Time Fig. 11A <Electric current for driving conventional tube pump>
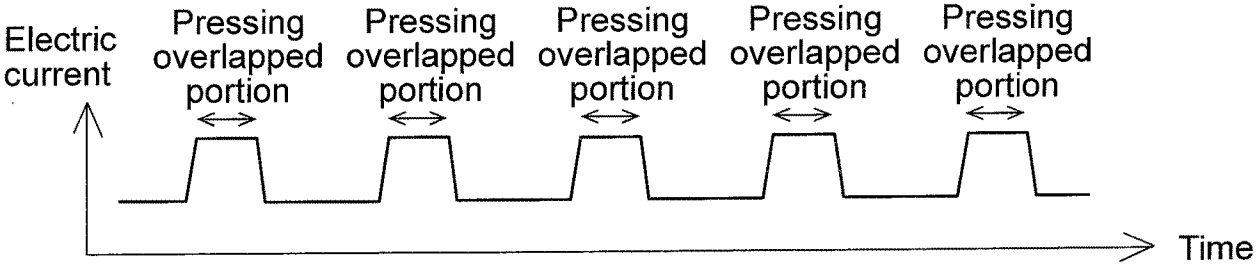
Fig. 11B <Electric current for driving conventional liquid jet head>
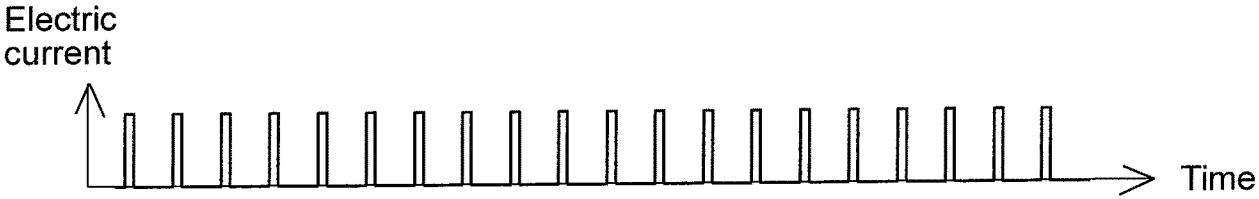
Fig. 11C <Fig. 11A + Fig. 11B>
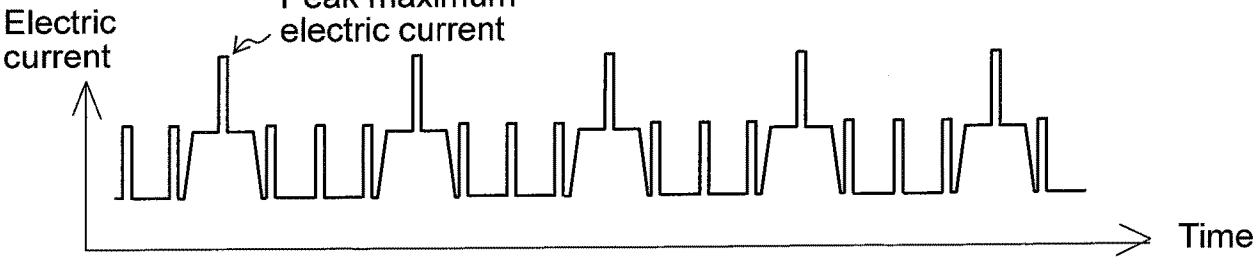

LIQUID DISCHARGING APPARATUS

CROSS REFERENCE TO RELATED APPLICATION

The present application claims priority from Japanese Patent Application No. 2016-007550, filed on Jan. 19, 2016, the disclosure of which is incorporated herein by reference in its entirety.

FIELD OF THE INVENTION

The present invention relates to liquid discharging apparatuses discharging liquid from nozzles.

DESCRIPTION OF THE RELATED ART

Conventionally, there are known liquid discharging apparatuses capable of carrying out a flushing process to discharge liquid thickened in nozzles by jetting the liquid from the nozzles toward a cap, and an air suction process to suck the liquid in the cap with a suction pump so as to discharge the liquid accumulated in the cap due to the flushing process. However, when the air suction process is carried out after the flushing process, then the entire maintenance time becomes long such that a long time is needed for proceeding to desired processes such as printing and the like. Therefore, it has been conceivable to facilitate reduction of the maintenance time by carrying out a simultaneous flushing and air suction process (simultaneous process) which performs the flushing process and the air suction process simultaneously.

SUMMARY

As the suction pump used in the air suction process, a tube connected with the cap is arranged along an inner peripheral wall of a cylindrical space formed in the casing, and a so-called tube pump may be used to suck the liquid in the cap with a pressing body rotating on the inner side of that tube to press the tube. Here, as viewed from an axial direction of the cylindrical space, the tube is arranged in an "a" shape, and some parts thereof may play a role as an overlapped portion overlapping with each other as viewed in the axial direction. When the pressing body presses the tube while rotating, the load for the pressing body that is positioned to press the overlapped portion becomes larger than the load for the pressing body that is not positioned to press the overlapped portion. Therefore, the electric current required for driving the tube pump increases.

FIGS. 11A to 11C are graphs illustrating current values in a conventional simultaneous flushing and air suction process, wherein the graph in FIG. 11A depicts the current value for driving the tube pump, the graph in FIG. 11B depicts the current value for driving a liquid jet head, and the graph in FIG. 11C depicts the sum of the current value for driving the tube pump and the current value for driving the liquid jet head. For carrying out the simultaneous flushing and air suction process, a power source is designed based on the estimated instant maximum current value of the entire system including the tube pump and the liquid jet head (see FIG. 11C). Therefore, as described above, with the tube pump having an overlapped portion, the current value of the tube pump increases when the pressing body is positioned to press the overlapped portion. Therefore, the instant maximum current value of the entire system is largely estimated, and hence there is such an adverse effect that an expensive power source is needed.

The present teaching is made in view of the above problem, and an object thereof is to suppress the increase of the instant maximum electric current in the simultaneous process in a liquid discharging apparatus capable of carrying out a simultaneous process such as the simultaneous flushing and air suction process or the like.

According to an aspect of the present teaching, there is provided a liquid discharging apparatus including:

- a liquid jet head including a plurality of nozzles;
- a receiving portion;
- a tube pump including:
  - a tube defining at least a part of a liquid discharge flow passage connected with the receiving portion,
  - a casing having an inner peripheral wall forming a cylindrical space to contain the tube along the inner peripheral wall such that the tube arranged along the inner peripheral wall has an overlapped portion at which a part of the tube overlaps with another part of the tube in an axial direction of the cylindrical space, and
  - a pressing body configured to press the tube arranged along the inner peripheral wall toward the inner peripheral wall while rotating about a rotating shaft provided along a central axis of the cylindrical space; and
- a controller configured to control the liquid jet head and the tube pump to:
  - acquire present positional information of the pressing body, and
  - perform, simultaneously, a flushing process to jet liquid from the plurality of nozzles into the receiving portion and a discharge process to discharge the liquid jetted into the receiving portion by operating the tube pump;
- wherein as the flushing process, the controller is configured to carry out a process of selectively performing either a first flushing process to jet the liquid at a predetermined jet amount from the plurality of nozzles or a second flushing process to control the liquid jet head so as to jet less of the liquid than the predetermined jet amount; and
- wherein when performing the flushing process and the discharge process simultaneously, the controller is configured to carry out either the first flushing process when acquiring the present positional information indicating that the pressing body is not positioned to press the overlapped portion of the tube or the second flushing process when acquiring the present positional information indicating that the pressing body is positioned to press the overlapped portion of the tube.

According to the present teaching, the second flushing process is carried out to control the liquid jet head such that when the flushing process and the discharge process are performed simultaneously, and when the pressing body is positioned to press the overlapped portion of the tube, the jet amount is smaller than that in the first flushing process which is carried out when the pressing body is not positioned to press the overlapped portion. Here, controlling the liquid jet head such that the amount of the liquid jetted from the plurality of nozzles may be smaller than the jet amount in the first flushing process includes both jetting the liquid from the plurality of nozzles at a smaller amount than that in the first flushing process, and not jetting the liquid at all from the plurality of nozzles. Therefore, even when the current value becomes larger to drive the tube pump because the pressing body is positioned to press the overlapped portion, it is still possible to reduce the current value to drive the ink jet head because on this occasion the second flushing process is carried out. Hence, as an entire system, it is possible to restrain the instant maximum current from increasing.

BRIEF DESCRIPTION OF THE DRAWINGS

FIGS. 7A to 7C are graphs depicting current values in the simultaneous flushing and air suction process, wherein FIG. 7A depicts the current value for driving a tube pump 24, FIG. 7B depicts the current value for driving an ink jet head 3, and FIG. 7C depicts the sum of the current value for driving the tube pump 24 and the current value for driving the ink jet head 3.

FIGS. 11A to 11C are graphs illustrating current values in a conventional simultaneous flushing and air suction process, wherein the graph in FIG. 11A depicts the current value for driving a tube pump, the graph in FIG. 11B depicts the current value for driving a liquid jet head, and the graph in FIG. 11C depicts the sum of the current value for driving the tube pump and the current value for driving the liquid jet head.

DESCRIPTION OF THE EMBODIMENTS

Referring to the accompanying drawings, an embodiment of the present teaching will be explained below.

<Overall Configuration of a Printer>

Figure 1:
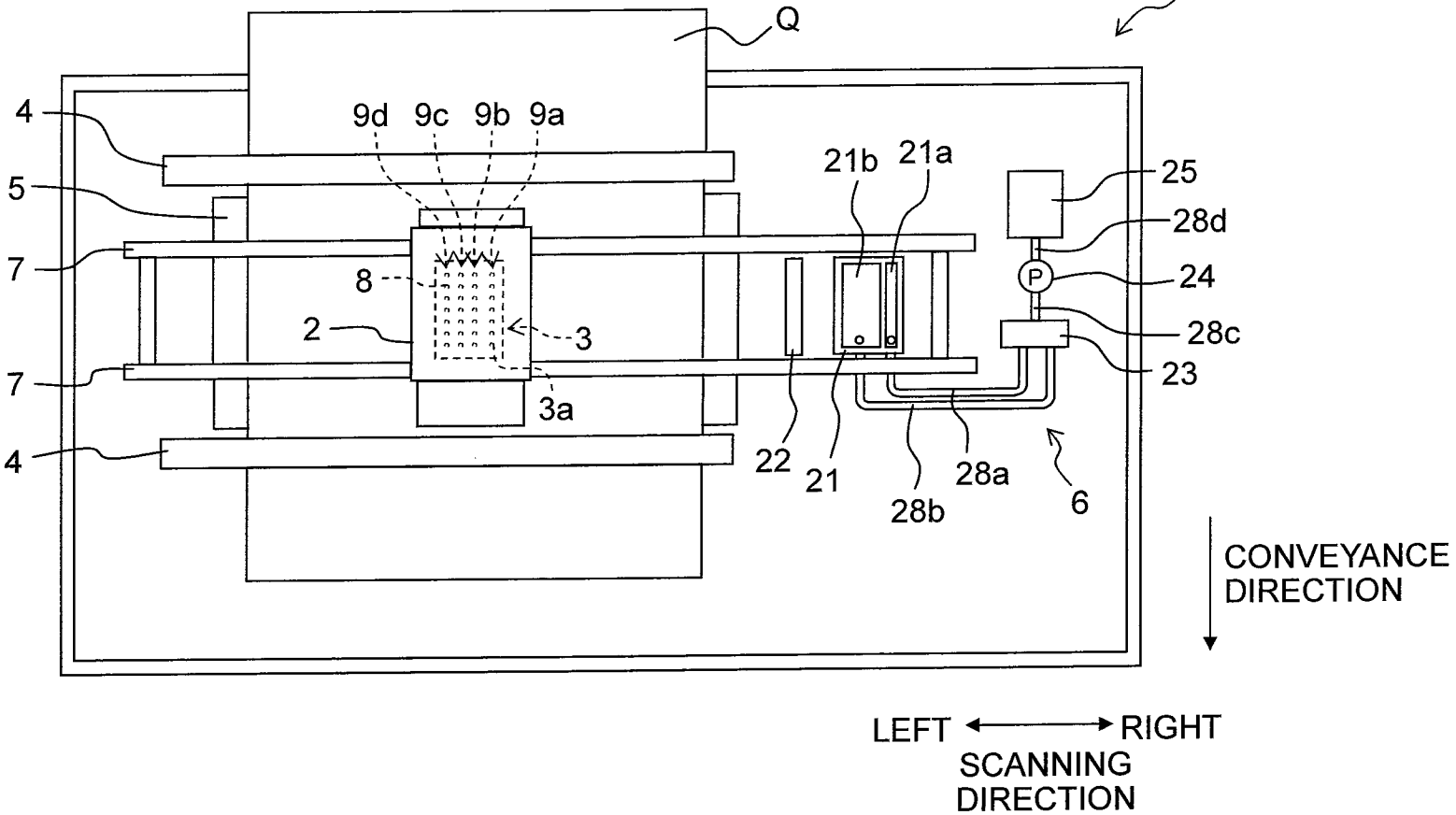
FIG. 1 is a schematic configuration diagram of a printer according to an embodiment of the present teaching.

FIG. 1 is a schematic configuration diagram of a printer 1 according to the embodiment of the present teaching. As depicted in FIG. 1, the printer 1 according to this embodiment includes a carriage 2, an ink jet head 3, conveyance rollers 4, a platen 5, a maintenance unit 6, and the like.

The carriage 2 is supported by a pair of guide rails 7 extending in a scanning direction, to be movable in the scanning direction. The carriage 2 is connected with a carriage motor 41 (see FIG. 3) via an unshown belt or pulley and driven by the carriage motor 41 to move reciprocatingly in the scanning direction. Further, the following explanation will be made with definition of the right side and the left side in the scanning direction as depicted in FIG. 1. Further, in FIG. 1, the perpendicular direction to the page corresponds to the vertical or up-down direction, while the near side corresponds to the upper side and the far side corresponds to the lower side.

The ink jet head 3 is mounted on the carriage 2. The ink jet head 3 has a lower surface which serves as a nozzle surface 3*a* where a plurality of nozzles 8 are formed to jet inks. The plurality of nozzles 8 form nozzle rows 9*a*, 9*b*, 9*c*, and 9*d* along a conveyance direction orthogonal to the scanning direction, and the nozzle rows 9*a*, 9*b*, 9*c*, and 9*d* align in this order from the right side to the left side in the scanning direction. The black ink is jetted from the nozzles 8 belonging to the nozzle row 9*a*. The yellow ink is jetted from the nozzles 8 belonging to the nozzle row 9*b*, the cyan ink is jetted from the nozzles 8 belonging to the nozzle row 9*c*, and the magenta ink is jetted from the nozzles 8 belonging to the nozzle row 9*d*, respectively. Hereinbelow, as necessary, the nozzles 8 of the nozzle row 9*a* will be referred to as the "black nozzles", while the nozzles 8 of the nozzle rows 9*b*, 9*c* and 9*d* will be referred to as the "color nozzles".

The conveyance rollers 4 are arranged one on each of the two sides of the carriage 2 in the conveyance direction. The conveyance rollers 4 are driven by a conveyance motor 42 (see FIG. 3) to convey recording paper Q in the conveyance direction. The platen 5 is arranged between the two conveyance rollers 4 in the conveyance direction to support from below the recording paper Q being conveyed by the conveyance rollers 4. Then, the printer 1 carries out printing on the recording paper Q by jetting the inks from the ink jet head 3 reciprocatingly moving along with the carriage 2 in the scanning direction while transporting the recording paper Q in the conveyance direction with the conveyance rollers 4.

<The Maintenance Unit>

The maintenance unit 6 is arranged on one side (the right side in this embodiment) of the platen 5 in the scanning direction. The maintenance unit 6 includes a cap 21, a wiper 22, a switching valve 23, a tube pump 24, a waste liquid tank 25, and the like.

Figure 3:
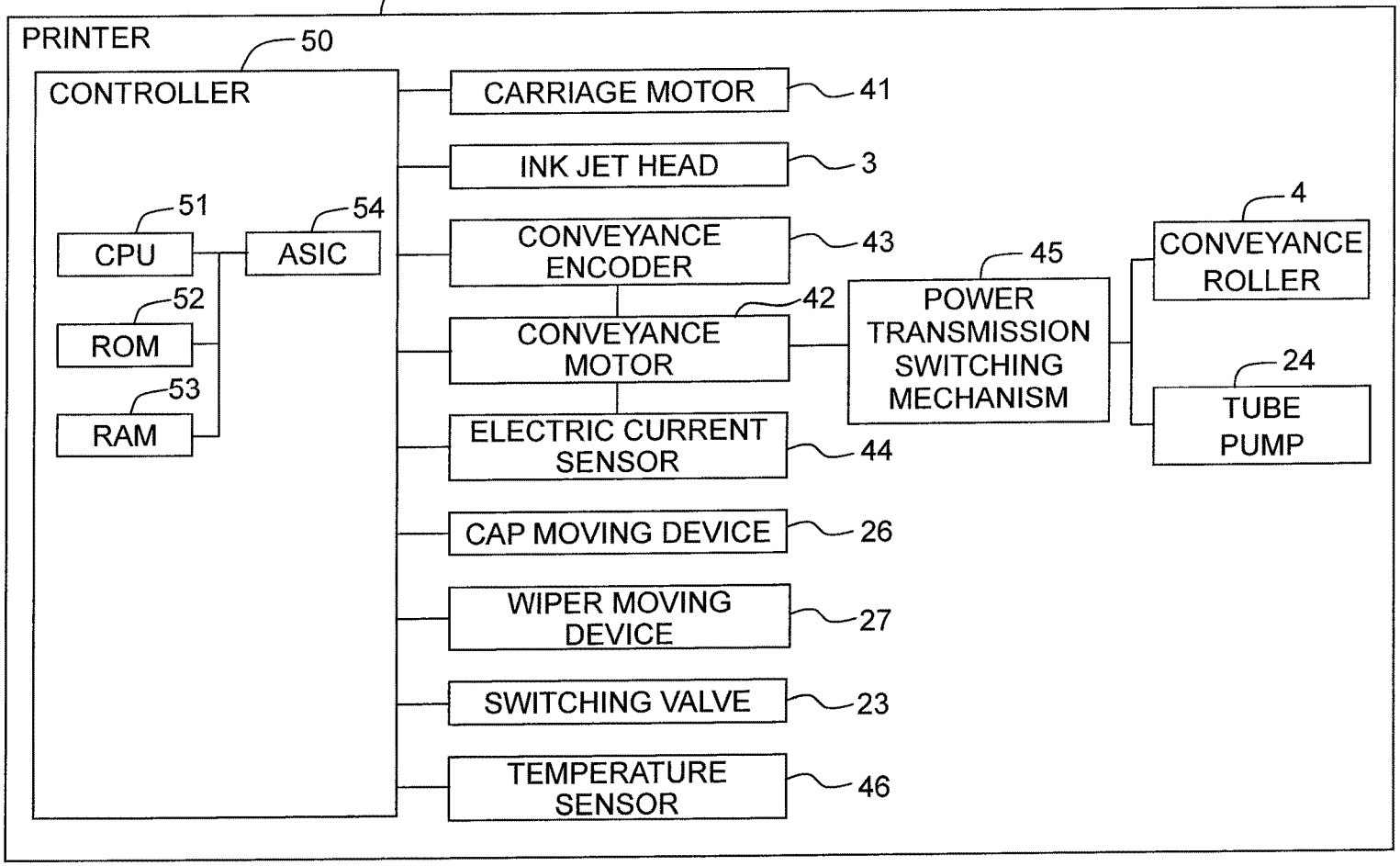
FIG. 3 is a block diagram depicting an electrical configuration of the printer.

The cap 21 is arranged on the right side of the platen 5 in the scanning direction, and configured to be capable of being raised and lowered by a cap moving device 26 (see FIG. 3). The cap 21 is made of rubber or the like. The cap 21 is formed from a recess 21*a* for the black ink and a recess 21*b* for the color inks which are open to the nozzle surface 3*a* and align in the scanning direction. The recess 21*a* for the black ink is able to cover the black nozzles 8 of the nozzle row 9*a* while the recess 21*b* for the color inks is able to cover the color nozzles 8 of the nozzle rows 9*b*, 9*c*, and 9*d*.

When the carriage 2 is moved in the scanning direction to a position as the nozzle surface 3*a* facing the cap 21, and when the cap moving device 26 raises the cap 21, then the cap 21 comes to contact with the nozzle surface 3*a*. On this occasion, the spaces formed by the recesses 21*a* and 21*b* and the nozzle surface 3*a* are not in communication with the atmosphere such that the cap 21 is in a state of being disconnected from the atmosphere. On the other hand, from this state, when the cap moving device 26 lowers the cap 21, then the cap 21 is separated from the nozzle surface 3*a* such that the recesses 21*a* and 21*b* come to communicate with the atmosphere and thus the cap 21 is in communication with the atmosphere. Hereinbelow, the term "contact position" refers to the position where the cap 21 is in contact with the nozzle surface 3*a* whereas the term "separate position" refers to the position where the cap 21 is separate from the nozzle surface 3*a*.

The wiper 22 is arranged between the platen 5 and the cap 21 in the scanning direction, and configured such that a wiper moving device 27 (see FIG. 3) can raise and lower the same. The wiper 22 is formed of a flexible material such as rubber or the like. With the wiper 22 raised by the wiper moving device 27 such that the upper end of the wiper 22 is positioned above the nozzle surface 3*a*, when the carriage 2 passes through the position facing the wiper 22, then the wiper 22 comes to contact with the nozzle surface 3*a* to carry out the wiping. On the other hand, with the wiper 22 lowered by the wiper moving device 27 such that the upper end of the wiper 22 is positioned below the nozzle surface 3*a*, even when the carriage 2 passes through the position facing the wiper 22, the wiper 22 does not come to contact with the nozzle surface 3*a*.

The switching valve 23 is connected with the recess 21*a* for the black ink via a connecting tube 28*a*, connected with the recess 21*b* for the color inks via a connecting tube 28*b*, and connected with the tube pump 24 via a connecting tube 28*c*. The tube pump 24 is connected with the switching valve 23 via the connecting tube 28*c* and, at the same time, connected with the waste liquid tank 25 via a connecting tube 28*d*. The waste liquid tank 25 serves for retaining the inks and the like discharged in the aftermentioned maintenance, and the space for retaining the inks and the like is in communication with the atmosphere.

When the switching valve 23 is switched to let the tube pump 24 communicate with the recess 21*a* for the black ink via the connecting tubes 28*a* and 28*c*, then it is possible for the tube pump 24 to suck the ink in the recess 21*a* for the black ink so as to discharge the same to the waste liquid tank 25. Further, when the switching valve 23 is switched to let the tube pump 24 communicate with the recess 21*b* for the color inks via the connecting tubes 28*b* and 28*c*, then it is possible for the tube pump 24 to suck the inks in the recess 21*b* for the color inks so as to discharge the same to the waste liquid tank 25.

<The Tube Pump>

Figure 2A:
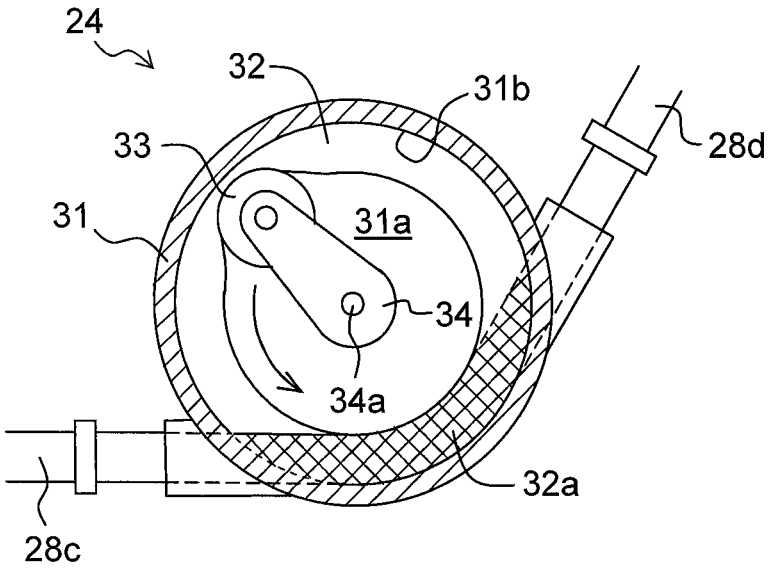
FIGS. 2A and 2B are vertical cross-sectional view depicting a schematic configuration of a tube pump.
Figure 2B:
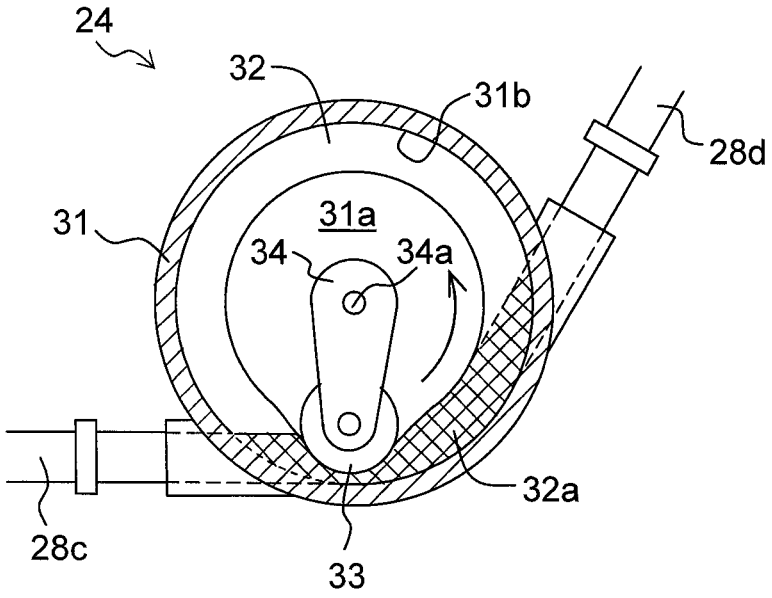

As depicted in FIGS. 2A and 2B, the tube pump 24 is configured to have a casing 31, a tube 32, a pressing body 33, a rotating body 34, and the like. The tube 32 is arranged along an inner peripheral wall 31*b* of a cylindrical space 31*a* formed in the casing 31. The tube 32 defines at least a part of a liquid discharge flow passage. Thus, it is possible to suck the inks in the cap 21 with the pressing body 33 pressing the inner side of the tube 32 while rotating.

The tube 32 is arranged in a spiral shape through nearly one and a half circles along the inner peripheral wall 31*b* and, as viewed from an axial direction of the cylindrical space 31*a* (a perpendicular direction to the page of FIGS. 2A and 2B), some parts thereof are arranged in an intersecting "α"shape. In other words, the tube 32 is arranged to form an overlapped portion 32*a* (the crosshatched part in FIGS. 2A and 2B) which let the abovementioned parts overlap with each other in the axial direction of the cylindrical space 31*a* in a circumferential part of the cylindrical space 31*a* (in the intersecting part). FIG. 2A depicts that the pressing body 33 is not positioned to press the overlapped portion 32*a* while FIG. 2B depicts that the pressing body 33 is positioned to press the overlapped portion 32*a*.

One end of the tube 32 drawn out of the casing 31 is connected to the connecting tube 28*c* whereas the other end is connected to the connecting tube 28*d*. By virtue of this, the tube 32 of the tube pump 24 is connected to the cap 21 via the connecting tubes 28*a* to 28*c* and, at the same time, connected to the waste liquid tank 25 via the connecting tube 28*d*. That is, the "liquid discharge flow passage" of the present teaching is constructed from the tube 32 of the tube pump 24 and the connecting tubes 28*a* to 28*d*. However, the tube 32 of the tube pump 24 may be directly connected to the cap 21 and the waste liquid tank 25 without being via the connecting tubes 28*a* to 28*d* and the like.

The pressing body 33 is a cylindrical member rotating on the inner side of the tube 32 about the central axis of the cylindrical space 31*a*. Further, the rotating body 34 is an elongated member capable of rotating about the central axis of the cylindrical space 31*a*. A rotating shaft 34*a* is provided in one end of the rotating body 34 to locate on the central axis of the cylindrical space 31*a* while the pressing body 33 is fitted at the other end. The pressing body 33 is fitted rotatably at the other end of the rotating body 34. Then, when the rotating body 34 rotates counterclockwise about the rotating shaft 34*a* in FIGS. 2A and 2B, the pressing body 33 rotates counterclockwise in FIGS. 2A and 2B while pressing the tube 32 toward the inner peripheral wall 31*b*. By virtue of this, the tube pump 24 sucks the inks accumulated in the cap 21, and the sucked inks are discharged to the waste liquid tank 25.

Here, as depicted in FIG. 3, the conveyance motor 42 mentioned earlier on is configured to switchable with a power transmission switching mechanism 45 between a state of being able to transmit the power to the conveyance rollers 4, and a state of being able to transmit the power to the tube pump 24 (in detail, to the rotating shaft 34*a* of the rotating body 34). In this embodiment, when the carriage 2 moves in the scanning direction to the position for the nozzle surface 3*a* to face the cap 21, then the power transmission switching mechanism 45 is mechanically actuated to switch the conveyance motor 42 to the state of being able to transmit the power to the tube pump 24 (for example, see Japanese Patent Application Laid-open No. 2010-17993). However, the operation of the power transmission switching mechanism 45 may be controlled by, for example, a controller 50.

<Electrical Configuration>

FIG. 3 is a block diagram depicting an electrical configuration of the printer 1. However, it does not show an electrical connecting relation but depicts a power transmission path between the conveyance motor 42, the power transmission switching mechanism 45, the conveyance rollers 4, and the tube pump 24. As depicted in FIG. 3, the controller 50 includes a CPU 51 (Central Processing Unit), a ROM 52 (Read Only Memory), a RAM 53 (Random Access Memory), an ASIC 54 (Application Specific Integrated Circuit), and the like. These members cooperate to control the operations of the carriage motor 41, the ink jet head 3, the conveyance motor 42, the cap moving device 26, the wiper moving device 27, the switching valve 23, and the like.

The conveyance motor 42 is provided with a convey encoder 43 for detecting a rotation angle of the conveyance motor 42, and a current sensor 44 for detecting the (electric) current value of the conveyance motor 42. Further, the printer 1 is provided with a temperature sensor 46 for measuring the environmental temperature. Output signals from the convey encoder 43, the current sensor 44 and the temperature sensor 46 are sent to the controller 50. By the way, the output signal from the convey encoder 43 (the output signal corresponding to the rotation angle) is used to acquire a convey amount of the recording paper Q in printing, while the output signal from the current sensor 44 (the current value) is used to detect a paper jam or the like of the recording paper Q in printing. The usage of the temperature sensor 46 will be explained later on.

FIG. 3 depicts only one CPU 51. The controller 50 may include only one CPU 51 to carry out necessary processes collectively with this one CPU 51. Alternatively, the controller 50 may include a plurality of CPUs 51 to carry out the necessary processes in a shared manner with those plurality of CPUs 51. Further, only one ASIC 54 is illustrated in FIG. 3. The controller 50 may include only one ASIC 54 to carry out necessary processes collectively with this one ASIC 54. Alternatively, the controller 50 may include a plurality of ASICs 54 to carry out the necessary processes in a shared manner with those plurality of ASICs 54.

<Maintenance>

Figure 4:
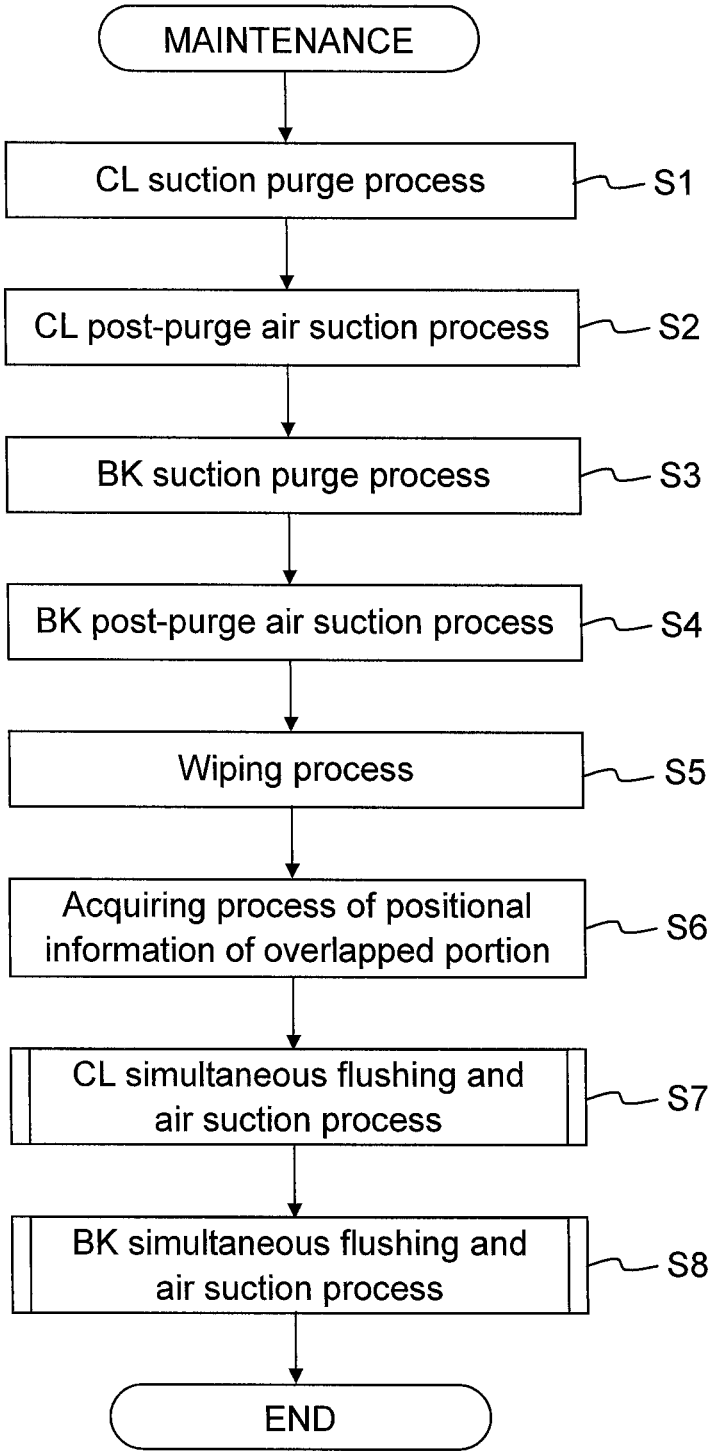
FIG. 4 is a flowchart depicting a flow of maintenance.

In order to maintain the ink jet head 3 in an appropriate state for printing, the printer 1 of the above configuration is constructed for the maintenance unit 6 to be able to carry out a maintenance process. A series of processes depicted in FIG. 4 may be carried out at each passage of a predetermined time or carried out according to a user's operation on an unshown operation portion or carried out when some other conditions are satisfied for carrying out the maintenance.

The maintenance includes, mainly, a suction purge process, a post-purge air suction process, a wiping process, and a simultaneous flushing and air suction process. Among those processes, the suction purge process, the post-purge air suction process and the simultaneous flushing and air suction process are targeted respectively at the black nozzles 8 of the nozzle row 9*a* and at the color nozzles 8 of the nozzle rows 9*b*, 9*c*, and 9*d*. In the following explanation, in order to distinguish the two, each of the above processes targeted at the black nozzles 8 is identified with the initial "BK" whereas each of the above processes targeted at the color nozzles 8 is identified with the initial "CL". When there is no need to particularly distinguish the two, then without the initial "BK" or the initial "CL", simply the suction purge process, the post-purge air suction process and the simultaneous flushing and air suction process are used for description.

First, in order to discharge the thickened inks from the color nozzles 8, the controller 50 carries out the CL suction purge process (step S1). In particular, the controller 50 drives the carriage motor 41 such that the nozzle surface 3*a* of the ink jet head 3 may face the cap 21 and, thereafter, lets the cap moving device 26 move the cap 21 to the contact position. On this occasion, the power transmission switching mechanism 45 switches the conveyance motor 42 to the state of being able to transmit the power to the tube pump 24. Further, the controller 50 switches the switching valve 23 such that the recess 21*b* for the color inks may communicate with the tube pump 24. In this state, with the controller 50 driving the conveyance motor 42, the tube pump 24 operates to suck the inks in the color nozzles 8. After the tube pump 24 operates for a predetermined time, driving the tube pump 24 is stopped.

Next, in order to discharge the inks accumulated in the recess 21*b* for the color inks due to the CL suction purge process, the controller 50 carries out the CL post-purge air suction process (step S2). In particular, the controller 50 lets the cap moving device 26 move the cap 21 from the contact position to the separate position such that the cap 21 may communicate with the atmosphere. In this state, with the controller 50 driving the conveyance motor 42, the tube pump 24 operates to suck the inks in the recess 21*b* for the color inks. After the tube pump 24 operates for a predetermined time, driving the tube pump 24 is stopped.

Further, the controller 50 carries out the BK suction purge process (step S3) and, thereafter, carries out the BK post-purge air suction process (step S4). As described above, the BK suction purge process and the CL suction purge process, as well as the BK post-purge air suction process and the CL post-purge air suction process, are basically the same process except for being targeted respectively at different nozzles. Therefore, explanation for the BK suction purge process and the BK post-purge air suction process are omitted.

Next, in order to wipe off the inks adhering to the nozzle surface 3*a*, the controller 50 carries out the wiping process (step S5). In particular, the platen 5 drives the wiper moving device 27 such that the upper end of the wiper 22 may be positioned above the nozzle surface 3*a*. Then, with the carriage motor 41 moving the carriage 2 in the scanning direction, the wiper 22 wipes off the inks adhering to the nozzle surface 3*a*.

When the suction purge process and the wiping process are carried out, there are cases where such a color mixture arises that other color inks are mixed into the nozzles 8 jetting one certain color ink. Therefore, the flushing process is carried out to jet the inks from the plurality of nozzles 8 toward the cap 21, and the air suction process is carried out to discharge the inks accumulated in the cap 21 due to the flushing process. However, when the air suction process is carried out after the flushing process, then because a long time is needed for the maintenance, in order to shorten the maintenance time, the printer 1 of this embodiment carries out the simultaneous flushing and air suction process which performs the flushing process and the air suction process simultaneously (steps S7 and S8). The simultaneous flushing and air suction process will be explained in detail later on.

Here, when the simultaneous flushing and air suction process is carried out, then it is necessary to have a power source capable of dealing with the instant maximum current which is the summation of the current value to drive the ink jet head 3 for the flushing process and the current value to drive the tube pump 24 for the air suction process. When the tube pump 24 is in operation, when the pressing body 33 is positioned to press the overlapped portion 32*a* as depicted in FIG. 2B, then compared with the pressing body 33 being not positioned to press the overlapped portion 32*a* as depicted in FIG. 2A, the load for the pressing body 33 to rotate is larger and thus the current value of the tube pump 24 becomes larger. The printer 1 of this embodiment is configured to reduce the above instant maximum current by restraining the flushing process when the pressing body 33 is positioned to press the overlapped portion 32*a*, that is, when the current value to drive the tube pump 24 becomes larger.

Right before carrying out the simultaneous flushing and air suction process, the controller 50 carries out an positional information of the overlapped portion acquirement process for acquiring positional information of the overlapped portion about the position for the pressing body 33 to press the overlapped portion 32*a* (step S6). In particular, with the cap 21 moved to the separate position, the controller 50 drives the conveyance motor 42 at a certain voltage to operate the tube pump 24 so as to rotate the pressing body 33 through about one to three circles. Further, in this embodiment, the above certain voltage is the same as the voltage for driving the conveyance motor 42 in the succeeding simultaneous flushing and air suction process.

Figure 5:
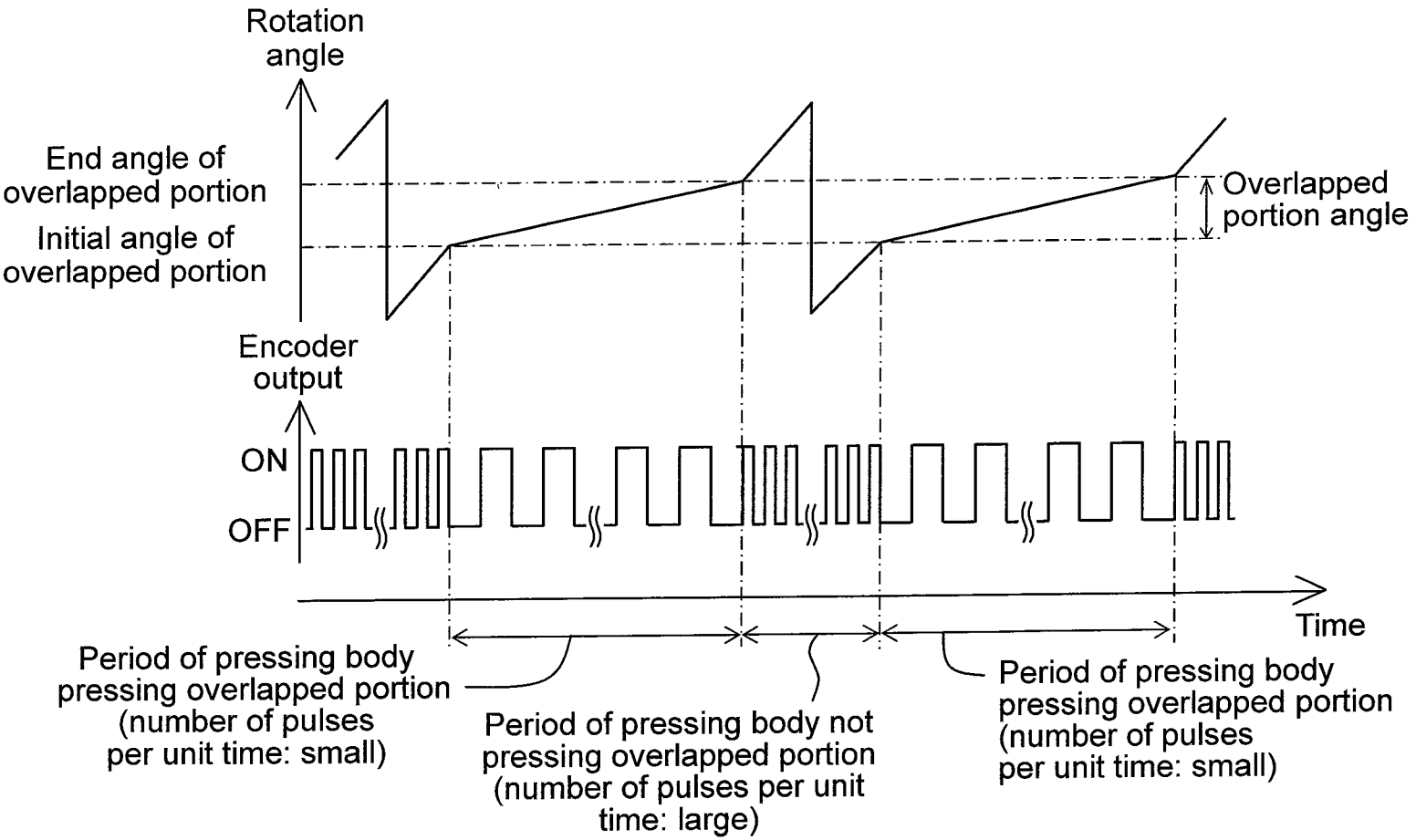
FIG. 5 is a graph depicting an example of output of an encoder.

FIG. 5 is a graph depicting an example of output of the convey encoder 43 when the conveyance motor 42 is driven at the certain voltage. As depicted in FIG. 5, along with the rotation of the pressing body 33, while the convey encoder 43 outputs a pulse signal, the lower the rotation speed of the pressing body 33, the longer the pulse period. That is, the lower the rotation speed of the pressing body 33, the smaller the number of pulses per predetermined time. When the pressing body 33 is positioned to press the overlapped portion 32*a* and its rotation speed becomes lower for the increased load, then the number of pulses becomes smaller per predetermined time. Therefore, when the number of pulses per predetermined time becomes smaller than a predetermined threshold value, then it is possible to determine that the pressing body 33 is positioned to press the overlapped portion 32*a*.

At this stage, the controller 50 acquires a rotation angle of the conveyance motor 42 as the "overlapped portion beginning angle" at the instant when the number of pulses per predetermined time has changed from the threshold value or more to less than the threshold value, and acquires a rotation angle of the conveyance motor 42 as the "overlapped portion ending angle" when the number of pulses per predetermined time has changed from less than the threshold value to the threshold value or more. The overlapped portion beginning angle and the overlapped portion ending angle correspond to the "positional information of the overlapped portion" of the present teaching. Further, because the angle of the overlapped portion 32*a* is known, when any one of the overlapped portion beginning angle and the overlapped portion ending angle is known, then with the known angle of the overlapped portion 32*a*, it is also possible to calculate the other angle.

Figure 6:
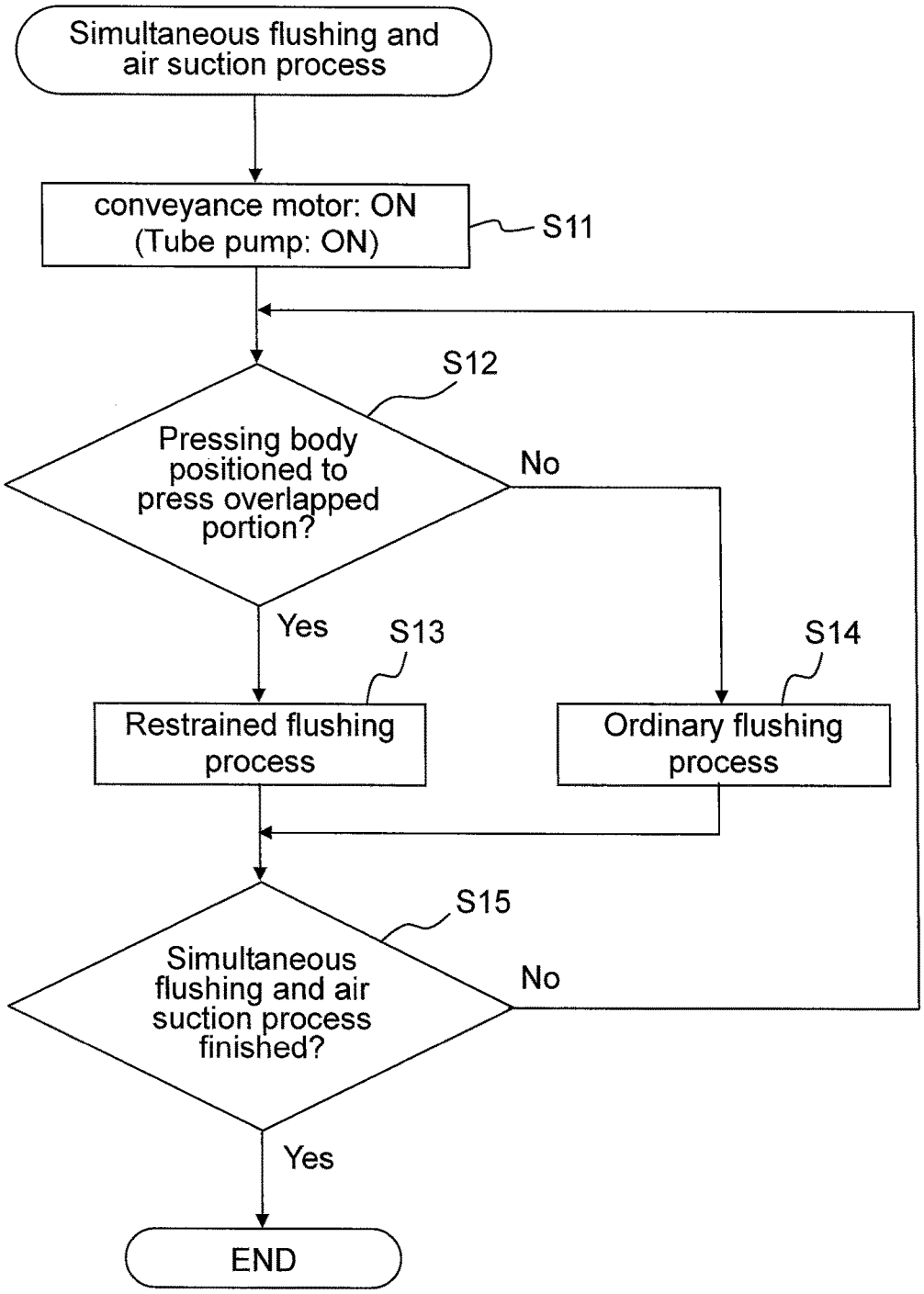
FIG. 6 is a flowchart depicting a flow of a simultaneous flushing and air suction process.

When the positional information of the overlapped portion acquirement process is finished, then the controller 50 finally carries out the CL simultaneous flushing and air suction process (step S7) and the BK simultaneous flushing and air suction process (step S8). As described above, the CL simultaneous flushing and air suction process and the BK simultaneous flushing and air suction process are basically the same process and, therefore, are explained here collectively in reference to FIG. 6.

In the simultaneous flushing and air suction process, with the cap 21 moved to the separate position, the controller 50 drives the conveyance motor 42 to operate the tube pump 24 (step S11). Further, when the cap 21 is kept in the state of being moved to the separate position and the tube pump 24 is kept in the operating state from the immediately previous positional information of the overlapped portion acquirement process, then the step S11 is omitted.

Next, the controller 50 determines whether or not the pressing body 33 is positioned to press the overlapped portion 32*a* (step S12). In particular, the controller 50 acquires the rotation angle of the conveyance motor 42 from the convey encoder 43 as the "present positional information" of the present teaching about the present position of the pressing body 33. Then, when the rotation angle of the conveyance motor 42 is larger than or equal to the overlapped portion beginning angle but smaller than or equal to the overlapped portion ending angle, then it is determined that the pressing body 33 is positioned to press the overlapped portion 32*a*. On the other hand, when the rotation angle of the conveyance motor 42 is either smaller than the overlapped portion beginning angle or larger than the overlapped portion ending angle, then it is determined that the pressing body 33 is not positioned to press the overlapped portion 32*a*.

When the pressing body 33 is not positioned to press the overlapped portion 32*a* (S12: No), then the controller 50 carries out an ordinary flushing process (step S14, also referred to as a first flushing process) to jet a predetermined jet amount of the inks from the color nozzles 8 or the black nozzles 8. On the other hand, when the pressing body 33 is positioned to press the overlapped portion 32*a* (S12: Yes), then the controller 50 carries out a restrained flushing process (step S13, also referred to as a second flushing process) not to jet the inks from the color nozzles 8 or the black nozzles 8.

Further, in the restrained flushing process, such an amount of the inks may be jetted from the nozzles 8 as smaller than the abovementioned predetermined jet amount. In order to reduce the ink jet amount, it is conceivable, for example, to reduce the size of the liquid drops jetted from the nozzles 8 and, meanwhile, to reduce the number of the nozzles 8 jetting the inks. By virtue of this, it is possible to reduce the current value for driving the ink jet head 3 in carrying out the restrained flushing process, compared with carrying out the ordinary flushing process.

Next, the controller 50 determines whether or not the simultaneous flushing and air suction process is finished (step S15). For example, when the time was preset to carry out the simultaneous flushing and air suction process and when the simultaneous flushing and air suction process has been carried out for that time, then it is possible to determine that the simultaneous flushing and air suction process is finished. When the simultaneous flushing and air suction process is not finished, then the steps S12 to S14 are repeated until the simultaneous flushing and air suction process is finished.

As depicted in FIG. 7A, when the pressing body 33 is positioned to press the overlapped portion 32*a*, then the current value becomes larger for driving the tube pump 24. On this occasion, however, because the restrained flushing process is carried out, it is possible to reduce the current value for driving the ink jet head 3. Therefore, as the entire system constructed from the tube pump 24 and the ink jet head 3, it is possible to restrain the instant maximum current from increasing; thereby a comparatively inexpensive power source will suffice.

<Determining Whether or not to Carry Out the Simultaneous Flushing and Air Suction Process>

So far, the printer 1 of this embodiment has been explained on the premise of carrying out the simultaneous flushing and air suction process. However, in a low temperature environment, the inks are thickened to require an increase in the driving voltage needed for the flushing process. Therefore, from the point of view of reliably suppressing the instant maximum current, in some cases, it is inherently better not to carry out the simultaneous flushing and air suction process. Thus, the controller 50 may be configured to determine whether or not to carry out the simultaneous flushing and air suction process.

In particular, it is possible to configure the controller 50 such that when the environment temperature measured by the temperature sensor 46 (see FIG. 3) is equal to or higher than a predetermined temperature, then the simultaneous flushing and air suction process is carried out, whereas when the environment temperature is lower than the predetermined temperature, then the simultaneous flushing and air suction process is not carried out. Such determination of whether or not to carry out the simultaneous flushing and air suction process may be carried out before the maintenance is started or at an appropriate timing even after the maintenance is started and before the simultaneous flushing and air suction process is carried out.

Even though the environment temperature is lower than the predetermined temperature, when a short time has elapsed since the inks were finally jetted from the nozzles 8, then thickening of the inks in the nozzles 8 may not advance so much. In such cases, it is possible to shorten the maintenance time by carrying out the simultaneous flushing and air suction process. Hence, even though the environment temperature measured by the temperature sensor 46 is lower than the predetermined temperature, when a predetermined time is longer than the elapsed time since the inks were finally jetted from the nozzles 8, then the controller 50 may still carry out the simultaneous flushing and air suction process.

In the embodiment explained above, the printer 1 corresponds to the "liquid discharging apparatus" of the present teaching. The inks correspond to the "liquid" of the present teaching. The ink jet head 3 corresponds to the "liquid jet head" of the present teaching. The nozzles 8 of any one of the nozzle rows 9*b*, 9*c*, and 9*d* correspond to the "first nozzle" of the present teaching while the nozzles 8 of any one of the other two of the nozzle rows 9*b*, 9*c*, and 9*d* correspond to the "second nozzle" of the present teaching. The recording paper Q corresponds to the "recording medium" of the present teaching. The cap 21 corresponds to the "receiving portion" of the present teaching. Further, the cap moving device 26 also functions as the "cap switching device" of the present teaching. The conveyance motor 42 also functions as the "drive motor" of the present teaching. The convey encoder 43 also functions as the "encoder" of the present teaching. Further, as the "discharge process" of the present teaching, the air suction process is carried out, while as the "simultaneous process" of the present teaching, the simultaneous flushing and air suction process is carried out.

<Effects of the Above Embodiment>

The printer 1 of this embodiment is capable of carrying out the simultaneous process which simultaneously performs the flushing process to jet the inks from the plurality of nozzles 8 and the discharge process to operate the tube pump 24 for discharging the inks in the receiving portion (the cap 21). Further, the printer 1 of this embodiment is capable of selectively carrying out, as the flushing process, either the ordinary flushing process to jet a predetermined jet amount of the inks from the plurality of nozzles 8 or the restrained flushing process to jet a smaller amount of the inks from the plurality of nozzles 8 than the predetermined jet amount. Further, in the simultaneous process, the printer 1 of this embodiment is configured to carry out the ordinary flushing process when the present positional information is acquired to indicate that the pressing body 33 is not positioned to press the overlapped portion 32*a* of the tube 32, and the restrained flushing process when the present positional information is acquired to indicate that the pressing body 33 is positioned to press the overlapped portion 32*a* of the tube 32. Therefore, even when the current value becomes larger to drive the tube pump 24 because the pressing body 33 is positioned to press the overlapped portion 32*a*, it is still possible to reduce the current value to drive the ink jet head 3 because on this occasion the restrained flushing process is carried out. Hence, as the entire system constructed from the ink jet head 3 and the tube pump 24, it is possible to restrain the instant maximum current from increasing.

Further, in the printer 1 of this embodiment, the controller 50 is configured not to jet the inks from the plurality of nozzles 8 in the restrained flushing process. Therefore, it is possible to greatly reduce the current value to drive the ink jet head 3 in carrying out the restrained flushing process and, as an entire system, it is thus possible to further effectively restrain the instant maximum current from increasing.

Further, in the printer 1 of this embodiment, the controller 50 is capable of carrying out the positional information of the overlapped portion acquirement process for acquiring the positional information of the overlapped portion which is the determination reference in determining whether or not the pressing body 33 is positioned to press the overlapped portion 32*a*. In the simultaneous process, the controller 50 is configured to determine whether or not to carry out either the ordinary flushing process or the restrained flushing process based on the result of comparing the present positional information with the positional information of the overlapped portion. According to such configuration, by carrying out the positional information of the overlapped portion acquirement process, because it is possible to acquire the positional information of the overlapped portion at any time, it is not necessary to acquire the positional information of the overlapped portion in advance.

Further, in the printer 1 of this embodiment, the controller 50 is configured to carry out the positional information of the overlapped portion acquirement process right before the simultaneous process. Therefore, it is possible to correctly and reliably acquire the positional information of the overlapped portion needed for carrying out the simultaneous process right before the process.

Further, the printer 1 of this embodiment further includes a drive motor (the conveyance motor 42) for rotating the pressing body 33. In the positional information of the overlapped portion acquirement process, the controller 50 is configured to acquire the positional information of the overlapped portion by using the information about the conveyance motor 42 obtained by the conveyance motor 42 rotating the pressing body 33. In this manner, by using the information about the conveyance motor 42, even when the pressing body 33 is not provided with a dedicated sensor or the like, it is still possible to acquire the positional information of the overlapped portion.

Further, the printer 1 of this embodiment further includes an encoder (the convey encoder 43) for detecting the rotation angle of the conveyance motor 42. In the positional information of the overlapped portion acquirement process, the controller 50 is configured to rotate the pressing body 33 by driving the conveyance motor 42 at a certain voltage, and acquire the positional information of the overlapped portion by using the output from the convey encoder 43 at that time. When the conveyance motor 42 is driven at the certain voltage, then the pressing body 33 has a larger load on being positioned to press the overlapped portion 32*a*, thereby lowering the rotation speed of the pressing body 33. By recognizing the change in the rotation speed of the pressing body 33 via the output from the convey encoder 43, it is possible to easily acquire the positional information of the overlapped portion.

Further, in the printer 1 of this embodiment, the above-mentioned certain voltage is the same as the voltage when driving the conveyance motor 42 in the simultaneous process. Therefore, in the positional information of the overlapped portion acquirement process and in the simultaneous process, because it is possible to drive the conveyance motor 42 at the same voltage, it is not necessary to change the voltage, and thereby it is possible to simplify the electric circuits used for the control.

Further, the printer 1 of this embodiment further includes the conveyance rollers 4 for transporting the recording medium (the recording paper Q), the conveyance motor 42 connected to the conveyance rollers 4 for driving the conveyance rollers 4, and the convey encoder 43 for detecting the rotation angle of the conveyance motor 42. The conveyance motor 42 doubles as a drive motor, while the convey encoder 43 doubles as another encoder. Therefore, it is possible to reduce the number of components of the printer 1.

Further, the printer 1 of this embodiment includes the cap 21, as a receiving portion, having the recesses 21*a* and 21*b* able to face the plurality of nozzles 8 and being able to contact with the nozzle surface 3*a* for covering the nozzles 8, and the cap switching device (the cap moving device 26) to switch the cap 21 between an atmosphere disconnection state for the cap 21 to contact with the nozzle surface 3*a* such that the space formed between the recesses 21*a* and 21*b* and the nozzle surface 3*a* does not communicate with the outside of the cap 21 and thus is sealed up, and an atmosphere communication state for the recesses 21*a* and 21*b* to communicate with the outside. The controller 50 is able to carry out the air suction process to jet the inks from the plurality of nozzles 8 toward the cap 21 in the flushing process, and to operate the tube pump 24 as the discharge process with the cap 21 in the atmosphere communication state. The controller 50 is able to carry out the simultaneous flushing and air suction process as the simultaneous process which simultaneously performs the flushing process and the air suction process. In the simultaneous flushing and air suction process, the controller 50 is configured to carry out the ordinary flushing process when the present positional information is acquired to indicate that the pressing body 33 is not positioned to press the overlapped portion 32*a* of the tube 32, and the restrained flushing process when the present positional information is acquired to indicate that the pressing body 33 is positioned to press the overlapped portion 32*a* of the tube 32. Therefore, in the course of carrying out the simultaneous flushing and air suction process, as the entire system constructed from the tube pump 24 and the ink jet head 3, it is possible to restrain the instant maximum current from increasing.

Further, in the printer 1 of this embodiment, the plurality of nozzles 8 include a plurality of first nozzles, and a plurality of second nozzles to jet inks of different types (colors) from the plurality of first nozzles. The cap 21 has the one recess 21*b* able to cover the plurality of first nozzles and the plurality of second nozzles. As the cap switching device, the cap moving device 26 is provided to move the cap 21 between the contact position to contact with the nozzle surface 3*a* and the separate position separated from the nozzle surface 3*a*. The controller 50 is configured to carry out the simultaneous flushing and air suction process with the cap 21 positioned in the separate position, that is, in the atmosphere communication state, after carrying out the suction purge process to operate the tube pump 24 with the cap 21 positioned in the contact position, that is, in the atmosphere disconnection state. When the suction purge process is carried out, other types of inks are liable to be mixed into the first nozzles and the second nozzles. Therefore, in order to reliably discharge those mixed inks, the ink jet amount is apt to be larger in the flushing process to be carried out thereafter. In such cases, by carrying out the simultaneous flushing and air suction process which simultaneously performs the air suction process and the flushing process, even when a large amount of the inks are jetted into the cap 21 in the flushing process, it is still possible to suck the inks in the air suction process before flowing out of the cap 21.

Other Embodiments

The present teaching is not limited to the above embodiment but it is possible to appropriately combine or apply various changes to the elements in the above embodiment without departing from the true spirit and scope of the present teaching.

For example, in the above embodiment, the certain voltage for driving the conveyance motor 42 in the positional information of the overlapped portion acquirement process is the same as the voltage for driving the conveyance motor 42 in the simultaneous flushing and air suction process. However, the above certain voltage may differ from the voltage for driving the conveyance motor 42 in the simultaneous flushing and air suction process. For example, when the above certain voltage is lower than the voltage for driving the conveyance motor 42 in the simultaneous flushing and air suction process, then because it is possible to reduce the electric power needed to drive the conveyance motor 42 in the positional information of the overlapped portion acquirement process, at that rate, it is possible, for example, to carry out the flushing process during the positional information of the overlapped portion acquirement process being carried out.

Figure 8:
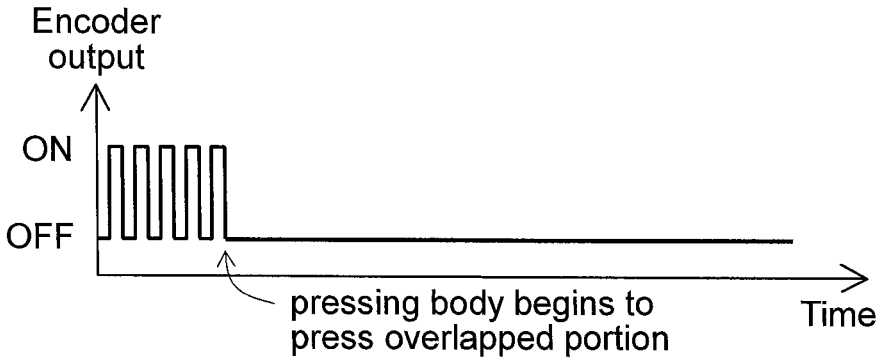
FIG. 8 is a graph depicting another example of output of the encoder.

Further, in the positional information of the overlapped portion acquirement process, the controller 50 may drive the conveyance motor 42 to rotate the pressing body 33 at such a torque as for the pressing body 33 to stop on beginning to press the overlapped portion 32*a*, so as to acquire the positional information of the overlapped portion by using the output from the convey encoder 43 at that time. FIG. 8 is a graph depicting an example of output of the convey encoder 43 when the conveyance motor 42 is driven at the above torque. When the pressing body 33 is rotated at such torque, when the pressing body 33 begins to press the overlapped portion 32*a*, then the pressing body 33 stops rotating and thus the convey encoder 43 no longer outputs the pulses. Therefore, it is possible for the controller 50 to acquire the rotation angle of the conveyance motor 42 as the "overlapped portion beginning angle" when the convey encoder 43 no longer outputs the pulses, and acquire such an angle as the "overlapped portion ending angle" which adds the known angle of the overlapped portion 32*a* to the overlapped portion beginning angle. When the pressing body 33 is rotated at such torque, then because it is possible to reduce the electric power needed to drive the conveyance motor 42 in the positional information of the overlapped portion acquirement process, at that rate, it is possible, for example, to carry out the flushing process during the positional information of the overlapped portion acquirement process being carried out. Further, because the pressing body 33 stops rotating on beginning to press the overlapped portion 32*a*, it is possible to more correctly and easily acquire the positional information of the overlapped portion.

Here, as described above, when the pressing body 33 is rotated by driving the conveyance motor 42 at a certain voltage in the positional information of the overlapped portion acquirement process and the certain voltage is lower than the voltage for driving the conveyance motor 42 in the simultaneous flushing and air suction process, or when the conveyance motor 42 is driven to rotate the pressing body 33 at such a torque that the pressing body 33 stops rotating on beginning to press the overlapped portion 32*a* in the positional information of the overlapped portion acquirement process, then it is possible to reduce the electric power needed to drive the conveyance motor 42 in the positional information of the overlapped portion acquirement process. Therefore, in those cases, by configuring the controller 50 to carry out the flushing process during the positional information of the overlapped portion acquirement process being carried out, it is possible to shorten the time needed for the simultaneous flushing and air suction process.

Further, in the above embodiment, it is determined whether or not to carry out either the restrained flushing process or the ordinary flushing process in the simultaneous flushing and air suction process based on the acquired output (the rotation angle) of the convey encoder 43 provided in the conveyance motor 42 as the present positional information of the pressing body 33. However, the present information is not limited to this but, for example, the above determination may be carried out based on the acquired output (the current value) of the current sensor 44 provided in the conveyance motor 42 as the present positional information.

Figure 9:
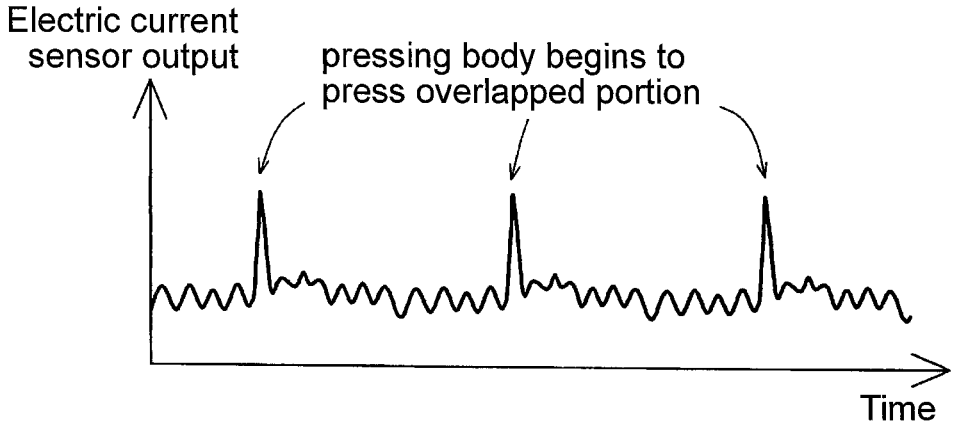
FIG. 9 is a graph depicting an example of output of a current sensor.

As depicted in FIG. 9, at the instant of the pressing body 33 beginning to press the overlapped portion 32*a*, the load of the conveyance motor 42 increases suddenly. Therefore, it is possible for a peak to arise in the output from the current sensor 44. Hence, the restrained flushing process may be carried out during a predetermined time from such a point as the current value exceeding a predetermined threshold value set for the current value which is the output from the current sensor 44. Further, the predetermined time refers to the time needed for the pressing body 33 to pass through the area of pressing the overlapped portion 32*a*.

Further, in the above embodiment, the positional information of the overlapped portion acquirement process is carried out right before the simultaneous flushing and air suction process. However, as long as the positional information of the overlapped portion acquirement process is carried out before the simultaneous flushing and air suction process, it is not necessary to carry out the same right before the simultaneous flushing and air suction process. For example, it is possible to carry out the positional information of the overlapped portion acquirement process incidentally when the tube pump 24 is driven in the suction purge process (step S1 or S3) or the post-purge air suction process (step S2 or S4) after starting the maintenance.

Further, the controller 50 may be preset with the positional information of the overlapped portion without carrying out the positional information of the overlapped portion acquirement process at all. In this case, as in the above embodiment, when the conveyance motor 42 is configured to be switchable with the power transmission switching mechanism 45 between the state of being able to transmit the power to the conveyance rollers 4 and the state of being able to transmit the power to the tube pump 24, then deviation is liable to arise between the output of the convey encoder 43 in switching and the preset positional information of the overlapped portion. Therefore, when the positional information of the overlapped portion is preset, then it is possible to provide a dedicated drive motor for the tube pump 24.

Further, in the above embodiment, the conveyance motor 42 for driving the conveyance rollers 4 doubles as the drive motor for rotating the pressing body 33. However, the drive motor is not limited to this configuration. For example, a paper feed motor for driving a pickup roller which sends the recording paper Q from the paper feed tray to the printing area may double as the drive motor. Alternatively, it is also possible to provide a dedicated drive motor for rotating the pressing body 33.

Further, it is possible to appropriately change the particular flow of the maintenance without limiting the same to the related explanation in the above embodiment. For example, in the suction purge process, the post-purge air suction process and the simultaneous flushing and air suction process, the processes may be first carried out for the black nozzles 8 and then for the color nozzles 8. Further, the CL post-purge air suction process and the BK post-purge air suction process may be carried out after finishing the CL suction purge process and the BK suction purge process.

Further, in the above embodiment, the cap 21 is formed with the recess 21*a* for the black ink and the recess 21*b* for the color inks. However, it is possible to form only one recess without two separated recesses. In this case, it is possible to compete each of the suction purge process, the post-purge air suction process and the simultaneous flushing and air suction process at one time.

Further, in the above embodiment, the cap moving device 26 functions as the "cap switching device" of the present teaching to switch the cap 21 between the atmosphere disconnection state and the atmosphere communication state. However, it is possible, for example, to adopt such a configuration as to provide the cap 21 with an atmosphere communication hole other than the suction hole connected to the tube pump 24, so as to let this atmosphere communication hole communicate with the atmosphere via a valve. According to such configuration, it is possible to let the cap 21 communicate with the atmosphere by opening the valve even when the cap 21 is in the contact position, and thereby it is possible to carry out the air suction process and the flushing process. Further, in this case, the valve functions as the cap switching device to switch the cap 21 between the atmosphere disconnection state and the atmosphere communication state.

Figure 10:
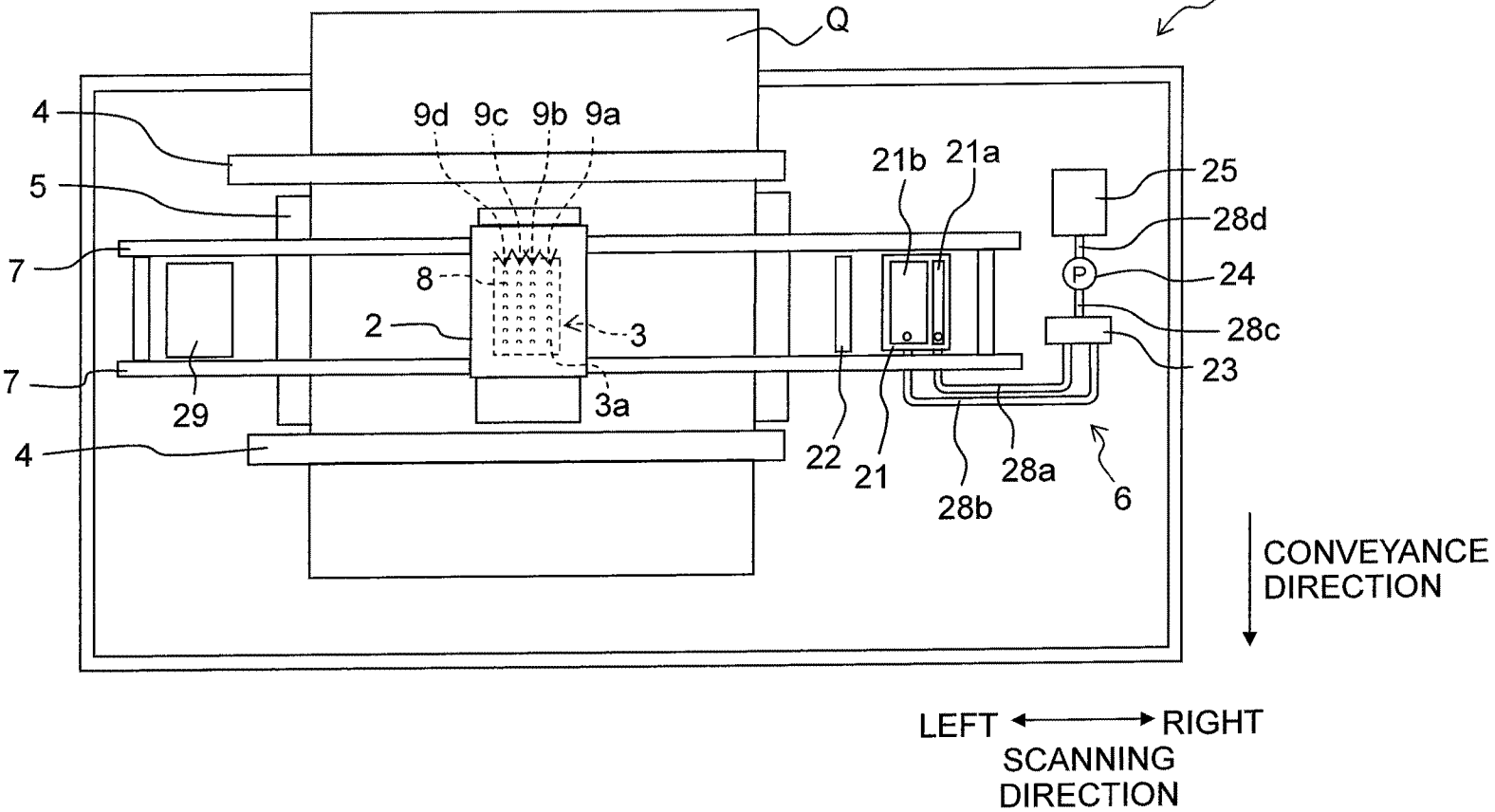
FIG. 10 is a schematic configuration diagram of a printer according to another embodiment of the present teaching.

Further, for example, as with a printer 101 depicted in FIG. 10, it may be configured to provide a flushing receiver 29 made of a sponge material or the like capable of absorbing the inks on the other side than the cap 21 across the platen 5 such that it is possible to carry out the flushing process to jet the inks from the plurality of nozzles 8 toward the flushing receiver 29. In this case, as the "simultaneous process" of the present teaching, the air suction process may be carried out for the tube pump 24 to suck the inks accumulated in the cap 21 while the flushing process is being carried out to jet the inks toward the flushing receiver 29.

Further, it may be configured to connect a tube pump to the flushing receiver 29 too. In this case, while the flushing process is being carried out to jet the inks toward the flushing receiver 29, as described above, it is possible to carry out such a simultaneous process as follows other than the simultaneous process which performs the air suction process for the tube pump 24 to suck the inks accumulated in the cap 21. That is, as the "simultaneous process" of the present teaching, while the flushing process is being carried out to jet the inks toward the flushing receiver 29, the discharge process may be carried out for the above tube pump to suck the inks accumulated in the flushing receiver 29. On this occasion, the flushing receiver 29 functions as the "receiving portion" of the present teaching.

Alternatively, it may be configured that the cap 21 is omitted and only the flushing receiver 29 is provided such that the tube pump is connected to the flushing receiver 29. In this case, the flushing receiver 29 corresponds to the "receiving portion" of the present teaching and, as the "simultaneous process" of the present teaching, while the flushing process is being carried out to jet the inks toward the flushing receiver 29, the discharge process may be carried out for the above tube pump to suck the inks accumulated in the flushing receiver 29. Still alternatively, it may be configured that the platen 5 is provided with a recess for receiving the inks and the flushing process can be carried out to jet the inks from the plurality of nozzles 8 toward (the recess of) the platen 5. Then, it may be configured to connect the tube pump to the platen 5 too. In this case, as the "simultaneous process" of the present teaching, while the flushing process is being carried out to jet the inks toward the platen 5, the air suction process may be carried out for the tube pump 24 to suck the inks accumulated in the recess of the platen 5. On this occasion, the platen 5 functions as the "receiving portion" of the present teaching.

Further, the simultaneous process (the simultaneous flushing and air suction process) of the present teaching includes not only the aspect of carrying out the whole flushing process to overlap with the discharge process (the air suction process) but also the aspect of carrying out part of the flushing process to overlap with the discharge process (the air suction process).

Further, the above embodiment applies the present teaching to the printer 1 which carries out printing by jetting the inks from the nozzles 8 onto the recording paper Q. However, the object for applying the present teaching is not limited to this. For example, the present teaching may be applied to devices which carry out printing by jetting ink to other matters than the recording paper Q (such as cans, bottles and the like), as well as be applied to devices jetting a wiring pattern for a wiring substrate (a liquid of a pattern material) onto a base material of the wiring substrate.

What is claimed is:

1. A liquid discharging apparatus comprising:

a liquid jet head including a plurality of nozzles;

a receiving portion;

a tube pump including:

a tube defining at least a part of a liquid discharge flow passage connected with the receiving portion, a casing having an inner peripheral wall forming a cylindrical space to contain the tube along the inner peripheral wall such that the tube arranged along the inner peripheral wall has an overlapped portion at which a part of the tube overlaps with another part of the tube in an axial direction of the cylindrical space, and a pressing body configured to press the tube arranged along the inner peripheral wall toward the inner peripheral wall while rotating about a rotating shaft provided along a central axis of the cylindrical space; and a controller configured to:

acquire present positional information of the pressing body; and control the liquid jet head to perform flushing to jet liquid from the plurality of nozzles into the receiving portion, and control the tube pump to perform discharging the liquid jetted into the receiving portion, simultaneously;

wherein when performing the flushing and the discharging, the controller is configured to carry out selectively performing either a first flushing to jet the liquid at a predetermined jet amount from the plurality of nozzles or a second flushing to control the liquid jet head so as to jet less of the liquid than the predetermined jet amount; and wherein when performing the flushing and the discharging simultaneously, the controller is configured to carry out either the first flushing when acquiring the present positional information indicating that the pressing body is not positioned to press the overlapped portion of the tube or the second flushing when acquiring the present positional information indicating that the pressing body is positioned to press the overlapped portion of the tube.

2. The liquid discharging apparatus according to claim 1, wherein the controller is configured to carry out the second flushing such that no liquid is jetted from the plurality of nozzles.

3. The liquid discharging apparatus according to claim 1, wherein the controller is configured to acquire positional information of the overlapped portion which is a reference in determining whether or not the pressing body is positioned to press the overlapped portion, and is configured to determine whether to carry out the first flushing or to carry out the second flushing when performing the flushing and the discharging simultaneously, based on the result of comparing the present positional information with the positional information of the overlapped portion.

4. The liquid discharging apparatus according to claim 3, wherein the controller acquires the positional information of the overlapped portion right before performing the flushing and the discharging simultaneously.

5. The liquid discharging apparatus according to claim 3, further comprising a drive motor for rotating the pressing body, wherein the controller is configured to acquire the positional information of the overlapped portion by using information obtained by the drive motor rotating the pressing body.

6. The liquid discharging apparatus according to claim 5, further comprising an encoder for detecting a rotation angle of the drive motor, wherein the controller is configured to acquire the positional information of the overlapped portion by using an output from the encoder on an occasion of rotating the pressing body by driving the drive motor at a certain voltage.

7. The liquid discharging apparatus according to claim 6, wherein the certain voltage is same as a voltage required for driving the drive motor when performing the flushing and the discharging simultaneously.

8. The liquid discharging apparatus according to claim 6, wherein the certain voltage is lower than a voltage required for driving the drive motor when performing the flushing and the discharging simultaneously.

9. The liquid discharging apparatus according to claim 8, wherein the controller carries out the flushing during the time of acquiring the positional information of the overlapped portion.

10. The liquid discharging apparatus according to claim 6, further comprising a conveyance roller for transporting a recording medium, wherein the drive motor is also connected to the conveyance roller to drive the conveyance roller, and the encoder detects a rotation angle of the conveyance motor.

11. The liquid discharging apparatus according to claim 5, further comprising an encoder for detecting a rotation angle of the drive motor, wherein the controller is configured to acquire the positional information of the overlapped portion by using an output from the encoder on the occasion of driving the drive motor to rotate the pressing body at a torque for the pressing body to stop rotating on beginning to press the overlapped portion.

12. The liquid discharging apparatus according to claim 1, further comprising:

a cap which corresponds to the receiving portion, which includes a recess capable of facing the plurality of nozzles and which is configured to contact with the liquid jet head to cover the plurality of nozzles, and a cap switching device configured to switch the cap between an atmosphere disconnection state in which the cap contacts with the liquid jet head such that a space formed between the recess and the liquid jet head does not communicate with the outside of the cap and thus the space is sealed up, and an atmosphere communication state in which the recess communicates with the outside, wherein the controller is configured to:

control the liquid jet head to jet the liquid from the plurality of nozzles toward the cap during the flushing, carry out an air suction as the discharging to operate the tube pump with the cap in the atmosphere communication state, upon performing the flushing and the discharging simultaneously, carry out a simultaneous flushing and air suction which simultaneously performs the flushing and the air suction, and carry out, in the simultaneous flushing and air suction, either the first flushing when acquiring the present positional information indicating that the pressing body is not positioned to press the overlapped portion of the tube or the second flushing when acquiring the present positional information indicating that the pressing body is positioned to press the overlapped portion of the tube.

13. The liquid discharging apparatus according to claim 12, wherein the plurality of nozzles include a plurality of first nozzles and a plurality of second nozzles configured to jet a different type of liquid from the plurality of first nozzles;

the cap includes the recess capable of covering the plurality of first nozzles and the plurality of second nozzles;

a cap moving device is provided as the cap switching device to move the cap between a contact position to contact with the liquid jet head to cover the plurality of nozzles and a separate position to separate from the liquid jet head; and the controller is configured to carry out the simultaneous flushing and air suction with the cap positioned in the separate position, after carrying out a suction purge to operate the tube pump with the cap positioned in the contact position.

14. The liquid discharging apparatus according to claim 1, wherein the pressing body includes an elongated rotating body rotating about the rotating shaft provided in one end of the rotating body, and a pressing portion provided rotatably at the other end of the rotating body to contact with the tube.

15. The liquid discharging apparatus according to claim 1, wherein the controller is configured to control the liquid jet head to jet the liquid from the plurality of nozzles at a smaller jet amount in the second flushing than in the first flushing.

16. The liquid discharging apparatus according to claim 15, wherein the controller is configured to control the liquid jet head to jet the liquid from the plurality of nozzles at a smaller size of liquid drops in the second flushing than in the first flushing.

17. The liquid discharging apparatus according to claim 15, wherein the controller is configured to control the liquid jet head to reduce a number of the nozzles simultaneously jetting the liquid in the second flushing as compared in the first flushing.

* * * * *